US007124976B1

(12) United States Patent
DeVincenzo

(10) Patent No.: US 7,124,976 B1
(45) Date of Patent: Oct. 24, 2006

(54) APPARATUS FOR DISPENSING SHEET MATERIAL FROM A ROLL

(76) Inventor: Jim DeVincenzo, 6644 Country Club Rd., Wesley Chapel, FL (US) 33544

( * ) Notice: Subject to any disclaimer, the term of this patent is extended or adjusted under 35 U.S.C. 154(b) by 0 days.

(21) Appl. No.: 10/883,947

(22) Filed: Jul. 2, 2004

Related U.S. Application Data

(63) Continuation-in-part of application No. 10/401,699, filed on Mar. 31, 2003, now abandoned.

(51) Int. Cl.
*B65H 23/06* (2006.01)
*B65H 59/02* (2006.01)

(52) U.S. Cl. ..... 242/423.1; 242/597.1; 242/155 M

(58) Field of Classification Search ..... 242/423.1, 242/423.2, 597.7, 155 M
See application file for complete search history.

(56) References Cited

U.S. PATENT DOCUMENTS 1,394,177 A * 10/1921 Jones ..... 403/247
4,487,376 A * 12/1984 Compton ..... 242/423.1
4,690,345 A * 9/1987 Cotey ..... 242/613.5
4,720,053 A * 1/1988 Vance ..... 242/423.2
4,738,385 A * 4/1988 Bell ..... 225/106
5,135,179 A * 8/1992 Morano ..... 242/423.1
5,167,377 A * 12/1992 Chalmers ..... 225/46
5,170,956 A * 12/1992 McTaggart ..... 242/422.4
5,474,250 A * 12/1995 Birkmann et al. ..... 242/547
5,788,136 A * 8/1998 Othman ..... 225/79
5,938,141 A * 8/1999 Kanbar ..... 242/423.1
6,145,771 A * 11/2000 Santa Cruz et al. ..... 242/423.1
6,257,512 B1 * 7/2001 Schoeck et al. ..... 242/170
6,357,687 B1 * 3/2002 Liu ..... 242/422.4
6,478,246 B1 * 11/2002 Fahringer ..... 242/423.2

* cited by examiner

*Primary Examiner*—Kathy Matecki
*Assistant Examiner*—Evan Langdon
(74) *Attorney, Agent, or Firm*—Frijouf, Rust & Pyle, P.A.

(57) ABSTRACT

An apparatus is disclosed for dispensing sheet material from a roll comprising a base supporting a shaft for extending through a core of a roll of the sheet material. A handle is slidably mounted relative to the shaft with a magnetic force located therebetween. The magnetic force spaces a stop surface of the handle from the roll of the sheet material for enabling the roll of the sheet material to rotated about the shaft to dispense sheet material from the roll. The handle enables an operator to slide the stop engaging surface against the roll of the sheet material for inhibiting rotation of the sheet material about the shaft to tear the dispensed sheet material from the roll.

7 Claims, 12 Drawing Sheets

APPARATUS FOR DISPENSING SHEET MATERIAL FROM A ROLL

CROSS-REFERENCE TO RELATED APPLICATIONS

This is a continuation-in-part of U.S. patent application Ser. No. 10/401,699 filed Mar. 31, 2003 now abandoned. All subject matter set forth in application Ser. No. 10/401,699 is hereby incorporated by reference into the present application as if fully set forth herein.

BACKGROUND OF THE INVENTION

1. Field of the Invention

This invention relates to dispensing and more particularly to an improved apparatus for dispensing a sheet material from a roll.

2. Background of the Invention

Various types of apparatuses have been proposed by the prior art for dispensing a sheet material from a role. Dispensers for dispensing a sheet material form a roll have been used in commercial as well as consumer applications. Among the most common sheet dispensers are the dispensers for dispensing a sheet of paper towels from a paper towel roll.

In a typical paper towel dispenser, a roll of paper towels is retained by a shaft extending through a core of the paper towel roll. The shaft is supported for enabling the paper towel roll to rotate on the shaft for dispensing paper towels thereby. In order to tear a sheet of the dispensed paper towel from the paper towel roll, the paper towel roll must be stopped from rotating about the shaft. Accordingly, dispensing of paper towels from the dispenser was a two-hand operation. One hand was required to inhibit rotation of the paper towel roll and one hand was required to tear the dispensed sheet of paper towel from a roll.

This two-handed operation was problematic when an operator had two soiled hands. The soiled hand required to inhibit rotation of the paper towel roll soiled the paper towels remaining on the paper towel roll. The following U.S. Patents are examples of attempts of the prior art to solve this problem.

U.S. Pat. No. 4,487,376 to F. A. Compton discloses a support for conventional roll of perforated paper towel including a base for mounting on a vertical or horizontal surface. A support rod is perpendicular to said base for holding the towel roll. A manually operable braking device impedes the unrolling of the towels when one is being torn off the roll.

U.S. Pat. No. 4,690,345 to J. Cotey discloses a portable dispenser for rolled paper products such as sheet material, comprising a base member and a cap member. The base is disc-shaped with an inwardly dished conical inner face. A centrally located upstanding retention means for non-rotatably engaging one end of the hollow inner core of a roll of sheet material, coaxial with the disc, projects from this inner face. An upstanding flange encircles the circumference of the disc, encasing one axial end of a roll of towels. The disc-like base has a flat, smooth outer face having a centrally located pivot on which the base member will rotate. The cap member is also disc-shaped with an inwardly dished conical inner face. A centrally located upstanding retention means for non-rotatably engaging the opposite end of the hollow inner core of the roll of sheet material projects from this inner face of the cap member. An upstanding knob or handle with an optional closed top projects from the outer face of the cap. The base member can be placed on any horizontal support surface so that the towel roll is held vertically. With one hand grasping or pushing down on the upstanding knob of the cap member, towel sheets may be pulled from the roll with the other hand. The entire dispenser assembly rotates about the center axis on the pivot of the base member.

U.S. Pat. No. 4,720,053 to R. F. Vance discloses a holder for a roll of paper which has a base shaped to prevent tipping over and which is provided with an upstanding pole for holding a roll of paper in place between a cap and the base. Upstanding parallel spaced guides guide the sheets of paper for removal and impeding material is placed on the base and pole to impede removal of the sheets.

U.S. Pat. No. 4,738,385 to R. Bell discloses a dispensing device including a base having an upstanding post with a gripping means on the upper end biased to a first position and movable to a second position. The hollow post telescopingly receives a roll of articles separated into individual segments and the gripping means can be pushed from the first position to frictionally grip the roll between the base and the gripping means so that the article can easily be separated from the roll without any rotation of the roll.

U.S. Pat. No. 5,135,179 to M. Morano discloses a dispenser for dispensing a paper sheet from a paper roll having a core. The dispenser can have a spindle made of two separate sleeves. The sleeves are inserted in opposite ends of the core and frictionally retained therein. A support is rotatably mounted in one sleeve to support the roll. A brake member is rotatably mounted in the other sleeve and selectively cooperates therewith to brake rotation of the roll on the support.

U.S. Pat. No. 5,167,377 to A. K. Chalmers discloses an animal waste plastic bag dispenser which stores a cylindrical roll of bags in a rotatable manner. A central core receives the roll rotatably, and is fixed between top and bottom plates. A cutting blade is disposed between the top and bottom plates to facilitate the separation of bags from the roll seriatim. A device compresses the end of the roll of plastic bags thereagainst, to prevent or limit free rotation of the roll of plastic bags when the device is transported. After a bag is separated from its roll for use in retrieving and confining refuse, such as animal waste, the bag can be attached to the dispenser thereby establishing the user to transport a used bag to a place of disposal. In addition, the dispenser includes a device for restraining an animal during a cleanup operation so as to prevent the animal from interfering with the operation.

U.S. Pat. No. 5,170,956 to W. R. McTaggart discloses a dispenser for rolled sheet material comprising a base, with a mandrel having a free end projecting from the base. The mandrel is receivable in the core to rotatably support the roll of material. A brake mechanism carried by the mandrel responds to longitudinally inwardly directed pressure on the free end of the mandrel by frictionally engaging the core to retard rotation of the roll.

U.S. Pat. No. 5,788,136 to S. V. Othman discloses an invention that relates to a paper roll holder with a brake for dispensing use of paper rolls or the like. The paper roll holder comprises a heavy base to which two column-like parts are fixed, against which the paper roll rests and in between which the paper runs and which at their ends have suitably shaped cutting edges or serration, if the paper web is not perforated. A split ring member including ring and wedge-shaped parts as well as a cover with a spring fixed to it are mounted in bearings to the column-like parts and a spring fixed to the base are all pressing the paper roll against the column-like parts. The form, roughness and weight of the cover and column-like parts the split ring member and the the spring forces of the springs are chosen so that by pulling the paper it easily unwinds but the paper breaks off with a little jerk using only one hand. In the roll holder also, paper rolls without a core can be used and then springs in the cover and base are not needed, or the holder can be built without the split ring member, in which case only the springs press the paper roll against the column-like parts. The holder is normally placed on the table but can also, by transforming the base, be fixed to the wall.

U.S. Pat. No. 5,938,141 to M. S. Kanbar discloses a holder for a paper towel roll in which wound about a tubular core is a band of absorbent paper sheeting divided by perforation lines into a series of interconnected towel sections. The roll is rotatably supported by the holder to permit a user to unwind the leading towel section from the roll and tear it off. To facilitate extraction of a single towel section from the roll without causing it to further unwind, a stop element is provided. The element is formed by a cap and a plug projecting therefrom, the plug being received in one end of the tubular core whereby the cap then abuts an end of the roll. In operation, as the user with one hand tears off the unwound leading section of the roll, with his other hand presses the cap of the stop element to arrest rotation of the roll and further unwinding thereof.

U.S. Pat. No. 6,357,687 to I. Liu discloses an easily tear-off tissue holder including a base, a shaft connected with and standing on the base, a fix rod connected with the shaft and having a slide hole for an upper small diameter connect rod of the shaft to fit and move up and down therein, and a press member connected on top of the fix rod to press down the fix rod and an elastic cylindrical member. When the press member is pressed down the fix rod and the elastic cylinder member, the elastic cylinder member with vertical slots and of narrow strips defined by every two neighboring vertical slots may elastically bend diametrically outward to push an inner wall of a cylindrical shaft of a coil tissue to stop the coil tissue immovable for easily tearing off a proper length of the tissue, by which the coil tissue may not be smeared in tearing off action.

Although the aforementioned prior art have contributed to the development of the art of dispensing a dispensing a sheet material from a roll, none of these prior art patents have solved the needs of this art.

Therefore, it is an object of the present invention to provide an improved apparatus for dispensing a sheet material from a roll that overcomes the problems of the prior art and provides a significant contribution to the dispensing art.

Another object of this invention is to provide an improved apparatus for dispensing a sheet material from a roll incorporating a magnetic force in association with a stop for inhibiting rotation of a roll of sheet material on a shaft.

Another object of this invention is to provide an improved apparatus for dispensing a sheet material from a roll that provides a simple and inexpensive solution for the art of dispensing a sheet material from a roll.

Another object of this invention is to provide an improved apparatus for dispensing a sheet material from a roll that may be shipped in an unassembled form and be readily assembled by an operator.

The foregoing has outlined some of the more pertinent objects of the present invention. These objects should be construed as being merely illustrative of some of the more prominent features and applications of the invention. Many other beneficial results can be obtained by modifying the invention with in the scope of the invention. Accordingly other objects and a full understanding of the invention may be had by referring to the summary of the invention, the detailed description setting forth the preferred embodiment in addition to the scope of the invention defined by the claims taken in conjunction with the accompanying drawings.

SUMMARY OF THE INVENTION

The present invention is defined by the appended claims with specific embodiments being shown in the attached drawings. For the purpose of summarizing the invention, the invention relates to an apparatus for dispensing sheet materials from a roll located on a core. The apparatus comprises a base having a base support surface and a base engaging surface. A shaft secured to the base for extending through the core of the roll of the sheet material. A handle has a stop engaging surface with a slider slidably mounting the handle relative to the shaft. A first and a second magnet are secured to the shaft and the handle, respectively, for providing a magnetic force therebetween. The magnetic force spaces the stop surface of the handle from the roll of the sheet material for enabling the roll of the sheet material to rotated about the shaft to dispense sheet material from the roll. The handle enables an operator to slide the stop engaging surface against the roll of the sheet material for inhibiting rotation of the sheet material about the shaft to tear the dispensed sheet material from the roll.

In a more specific embodiment of the invention, a base support surface provides a surface for resting on a horizontal ambient surface or for mounting on a vertical ambient surface. The shaft comprises a shaft bore defined in the shaft for slidably receiving the slider.

In one example of the invention, the slider comprises a rod extending between a first and a second end. The first end of the rod has a rod slider for sliding engagement with the shaft bore. The second end of the rod has a rod attachment for removably attaching the handle to the rod. A retainer is secured to the shaft with the retainer having a retainer orifice for slidably receiving the rod with the rod slider slidably engaging the shaft bore and with the rod attachment extending outward from the shaft bore for attaching handle the handle to the rod.

In another example of the invention, the rod attachment comprises a threaded shaft for threadably engaging with a threaded opening in the handle for securing the handle to the rod slider. The retainer orifice and the rod slider are keyed for preventing rotation between the rod slider and the shaft for enabling the handle to be threadably disengaged from the rod slider. The rod slider is enlarged relative to the retainer orifice for inhibiting removal of the slider rod from the shaft for enabling the apparatus to be lifted by the handle.

In another example of the invention, the slider comprises a rod extending between a first and a second end. The first end of the rod has a rod slider for sliding engagement with the shaft bore. The second end of the rod has a rod extender for removably attaching the handle to the rod. A retainer is secured to the shaft with the retainer having a retainer orifice for slidably receiving the rod with the rod slider slidably engaging the shaft bore and with the rod extender extending outward from the shaft bore for attaching handle the handle to the rod.

In another example of the invention, the rod extender comprises a threaded rod for threadably engaging with an interior threading in the handle for securing the handle to the rod slider. The retainer orifice and the rod slider are keyed for preventing rotation between the rod slider and the shaft for enabling the handle to be threadably disengaged from the rod slider. The rod slider is enlarged relative to the retainer orifice for inhibiting removal of the slider rod from the shaft for enabling the apparatus to be lifted by the handle.

The foregoing has outlined rather broadly the more pertinent and important features of the present invention in order that the detailed description that follows may be better understood so that the present contribution to the art can be more fully appreciated. Additional features of the invention will be described hereinafter which form the subject of the claims of the invention. It should be appreciated by those skilled in the art that the conception and the specific embodiments disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims.

BRIEF DESCRIPTION OF THE DRAWINGS

For a fuller understanding of the nature and objects of the invention, reference should be made to the following detailed description taken in connection with the accompanying drawings in which.

Similar reference characters refer to similar parts throughout the several Figures of the drawings.

DETAILED DISCUSSION

Figure 2:
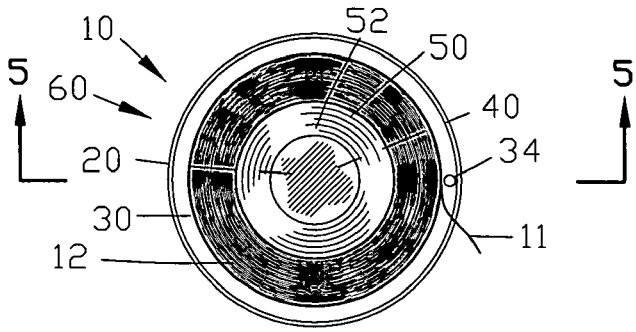
FIG. 2 is a top view of FIG. 1.

FIGS. 1–5 are various views of a first embodiment of an apparatus 10 for dispensing sheet material 11 from a roll 12 wrapped about a core 20 incorporating the present invention. The core 20 may be a conventional cardboard core 20 extending between a first and a second end 21 and 22.

The apparatus 10 comprises a base 30 having a base support surface 31 and a base engaging surface 32. The base support surface 31 provides a surface for resting on an ambient surface 14. The base support surface 31 may be permanently mounted to an ambient horizontal surface 14 by a suitable mechanical fastener or an adhesive fastener. An sheet keeper 34 extends from the base 30 for preventing the unrolling of the sheet material 11 from the roll 12 wrapped about the core 20.

The apparatus 10 comprises a shaft 40 secured to the base 30 for extending through the core 20 of the roll 12 of the sheet material 11. A handle 50 includes a stop engaging surface 51 and a depression surface 52. The handle 50 is slidably mounted relative to the base 30. A magnetic force 60 spaces the stop engaging surface 51 of the handle 50 from the roll 12 of the sheet material 11 for enabling the roll 12 of the sheet material 11 to rotated about the shaft 40 to dispense sheet material 11 from the roll 12.

The handle 50 enables an operator to apply a force to the depression surface 52 to slide the stop engaging surface 51 of the handle 50 against the roll 12 of the sheet material 11. The stop engaging surface 51 engaging against the roll 12 of the sheet material 11 inhibits rotation of the roll 12 of the sheet material 11 about the shaft 40 to tear the dispensed sheet material 11 from the roll 12.

Figure 5:
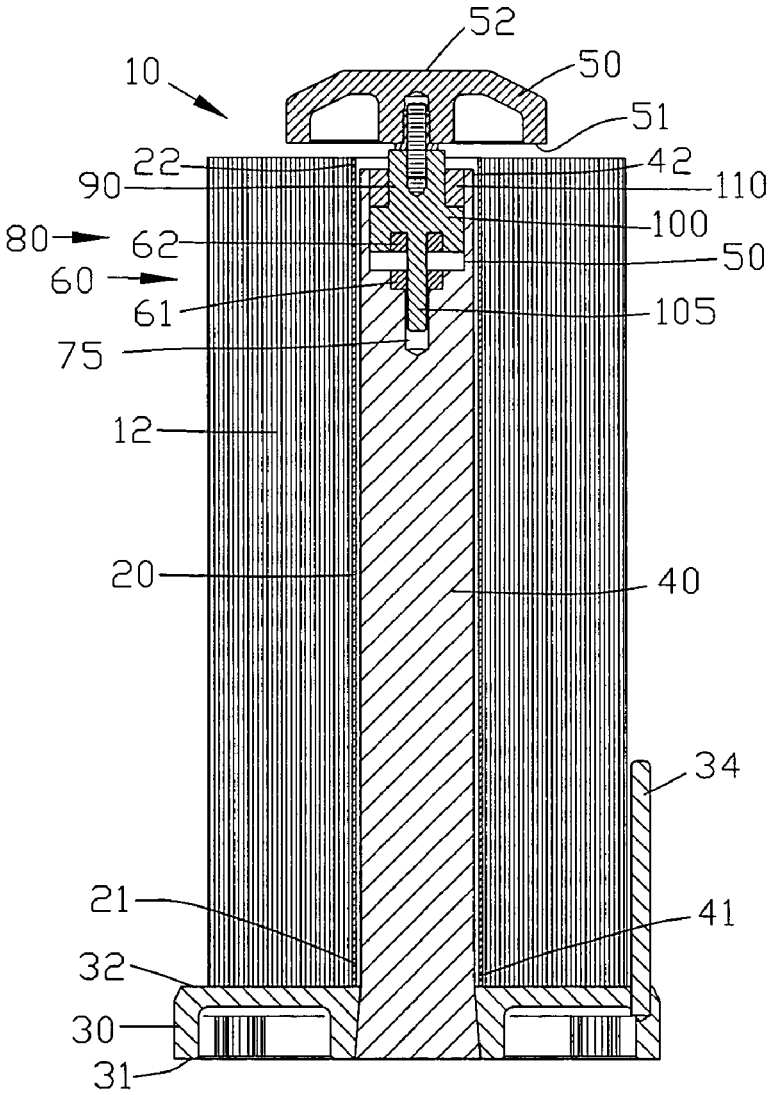
FIG. 5 is a sectional view along line 5—5 in FIG. 2.
Figure 6:
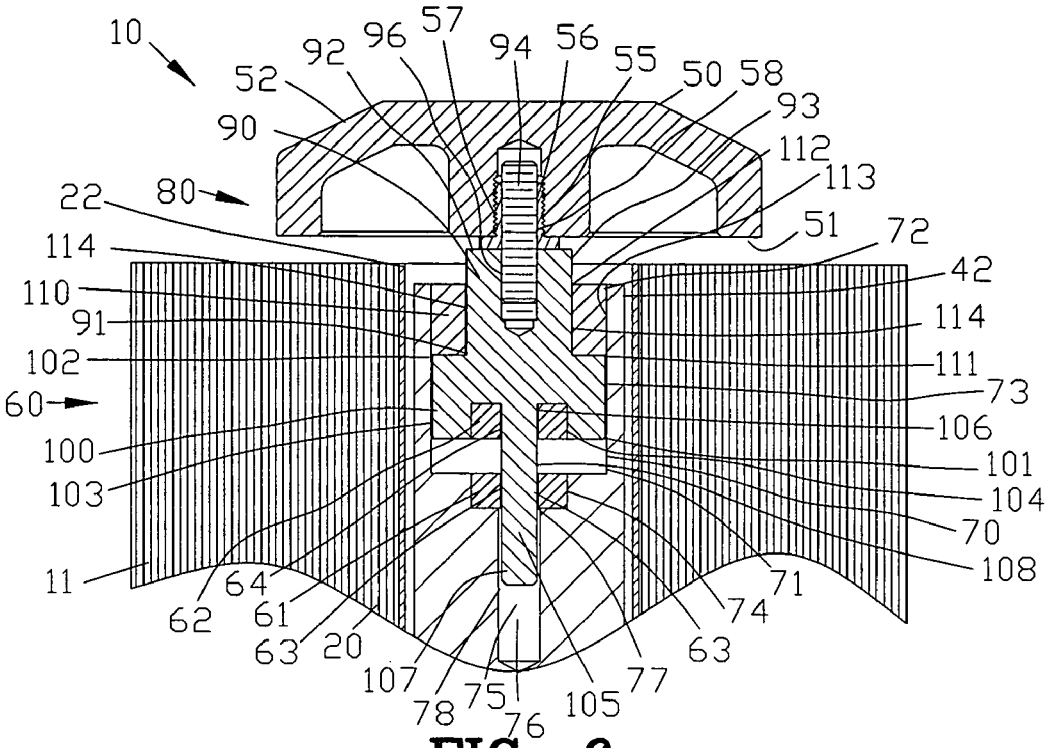
FIG. 6 is a magnified view of an upper portion of FIG. 5.
Figure 7:
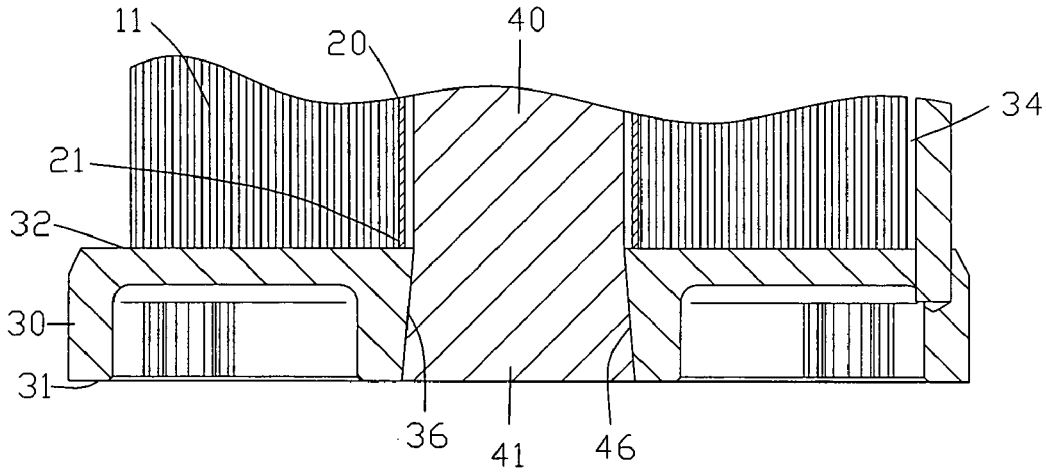
FIG. 7 is a magnified view of a lower portion of FIG. 5.

FIGS. 6 and 7 are enlarged views of portions of FIG. 5. In this example of the invention, the shaft 40 extends between a first and a second end 41 and 42. The first end 41 of the shaft 40 has a shaft mechanical fastener 46 cooperating with a base mechanical fastener 36 for securing the shaft 40 to the base 30. Preferably, the first end 41 of the shaft 40 has a taper 46 for cooperating with a taper aperture 36 for securing the shaft 40 to the base 30 by a mechanical engagement. In the alternative, the first end 41 of the shaft 40 may be provided with threads or the like (not shown) for cooperating with a threaded aperture and the like (not shown) in the base 30 for securing the shaft 40 to the base 30 by a mechanical engagement.

The magnetic force 60 is provided by a first and a second magnet 61 and 62. Each of the first and second magnets 61 and 62 comprises a magnetic annulus having central apertures 63 and 64, respectively. The first and second magnets 61 and 62 are orientated to provide a magnetic repulsive force therebetween.

The second end 42 of the shaft 40 has a shaft bore 70 extending between a first and a second end 71 and 72. The shaft bore 70 defines an internal sidewall 73. In this example, the shaft bore 70 defines a generally cylindrical sidewall 73.

A shaft recess 74 is defined in the first end 71 of the shaft bore 70. The shaft recess 74 is dimensioned to receive the first magnet 61. The shaft recess 74 is dimensioned to receive the first magnet 61 within the shaft recess 74. Preferably, the first magnet 61 is received within the shaft recess 74 in a press fit or frictional engagement. In the alternative, the first magnet 61 may be secured within the shaft recess 74 by an adhesive or any other suitable means.

A counterbore 75 extends from the first end 71 of the shaft bore 70 toward the first end 41 of the shaft 40. The counterbore 75 extends between a first and a second end 76 and 77 and defines an internal sidewall 78. The counterbore 75 is aligned with the central apertures 63 of the first magnet 61 located within the shaft recess 74.

Figure 8:
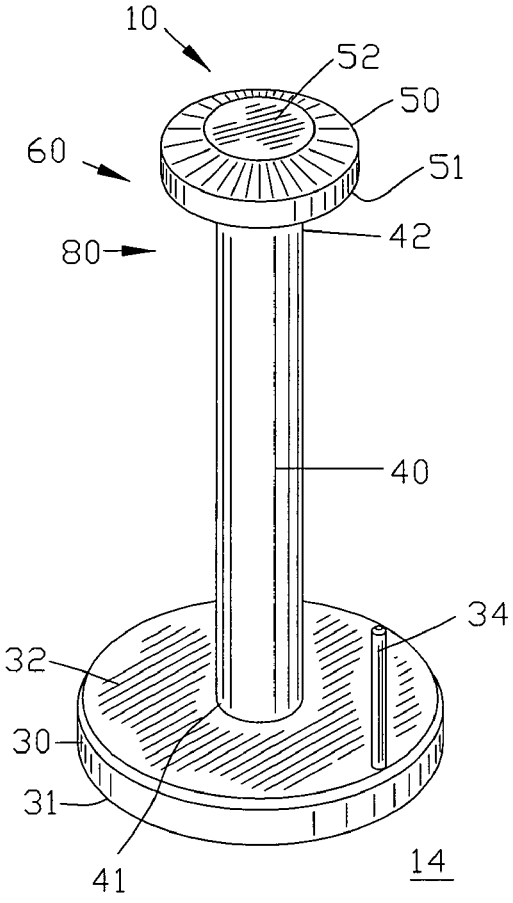
FIG. 8 is an isometric view of the apparatus of FIGS. 1–7 without the roll of sheet material.
Figure 9:
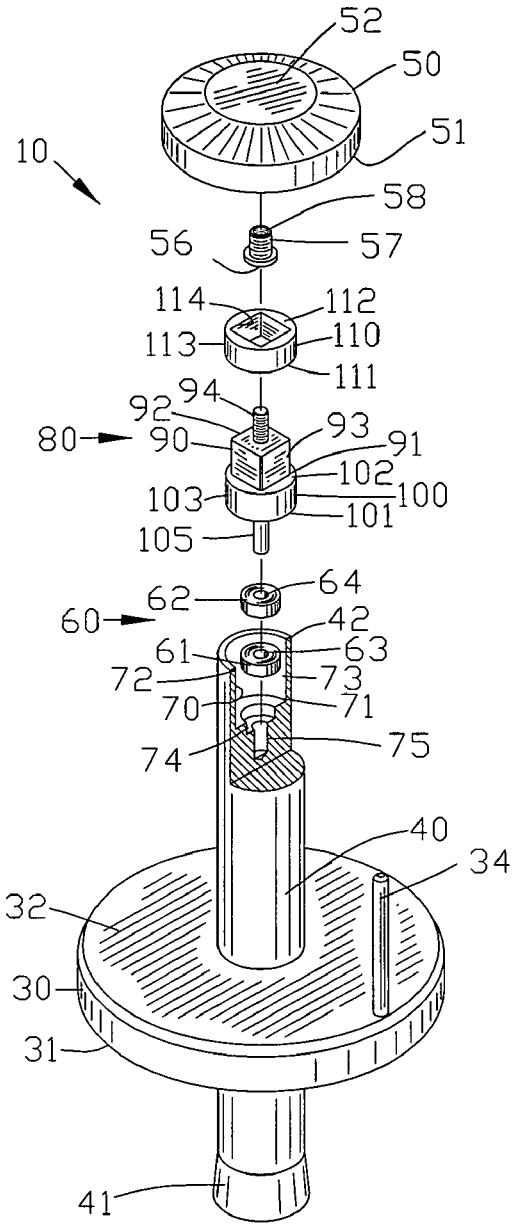
FIG. 9 is an exploded view of FIG. 8.

FIGS. 8 and 9 are isometric assembled and exploded views of the apparatus 10 of FIGS. 1–7 without the roll 12 of sheet material 11 thereon. The handle 50 is slidably mounted relative to the base 30 by a slider 80. The slider 80 comprises a rod 90 having a rod slider 100 and a retainer 110. The rod 90 extends between a first and a second end 91 and 92. The rod 90 defines a keyed sidewall 93. The sidewall 103 of the rod slider 100 is adapted to be slidably received by the internal sidewall 73 of the shaft bore 70 in a sliding engagement. In this example, the keyed sidewall 93 is shown as having a generally square cross-section.

The rod slider 100 extends between a first and a second end 101 and 102. The rod slider 100 defines a sidewall 103 having a generally circular cross-section. The second end 102 of the rod slider 100 is secured to the first end 91 the rod 90. Preferably, the rod 90 and the rod slider 100 are formed as a unitary one pieced unit.

A rod slider recess 104 is defined in the first end 101 of the rod slider 100. The rod slider recess 104 is dimensioned to receive the second magnet 62. The shaft recess 74 is dimensioned to receive the first magnet 61 within the shaft recess 74. Preferably, the second magnet 62 is received within the rod slider recess 104 in a press fit or frictional engagement. In the alternative, the second magnet 62 may be secured within the rod slider recess 104 by an adhesive or any other suitable means.

The first end 101 of the rod slider 100 supports an alignment rod 105. The alignment rod 105 extends between a first and a second end 106 and 107 and defines a sidewall 108. The alignment rod 105 is coaxial with the rod slider recess 104.

The rod slider 100 is slidably received within the shaft bore 70 to form a sliding engagement. Simultaneously, the alignment rod 105 is slidably received within the counterbore 75. The alignment rod 105 assists in the alignment of the first magnet 61 relative to the second magnet 62.

A rod attachment 94 is secured to the second end 92 of the rod 90 for removably attaching the handle 50 to the rod 90. In this example, the rod attachment 94 is shown as a threaded stud 94. A threaded aperture 96 is defined in the second end 92 of the rod 90. The rod attachment 94 is threaded into the threaded aperture 96 of the rod 90 for securing the threaded stud 94 to the rod 90. Preferably, the rod attachment 94 is secured within the threaded aperture 96 of the rod 90 to prevent rotation of the rod attachment 94.

A retainer 110 is secured to the shaft 40 for retaining the rod 90 relative to the shaft 40. The retainer 110 extends between a first and a second end 111 and 112 and defines a generally cylindrical sidewall 113. The sidewall 113 of the retainer 110 is adapted to be received by the internal sidewall 73 of the shaft bore 70.

The retainer 110 is affixed within the shaft bore 70 in proximity to the second end 72 of the shaft 70. The sidewall 103 of the rod slider 100 is adapted to be slidably received by the internal sidewall 73 of the shaft bore 70 in a sliding engagement.

The retainer 110 includes a retainer orifice 114 extending between the first and second ends 111 and 112 of the retainer 110. The retainer orifice 114 is shown as having a generally square cross-section for slidably receiving the keyed sidewall 93 of the rod 90. The keyed retainer orifice 114 cooperates with the keyed rod 90 for preventing rotation between the rod 90 and the shaft 40.

The generally circular cross-section of the sidewall 103 of the rod slider 100 is greater than the generally square cross-section of the retainer orifice 114 of the retainer 110. The rod slider 100 is inhibited from being removed from the bore 70 of the shaft 40 by the rod slider 100 being enlarged relative to the retainer orifice 114. The rod slider 100 is slidably retained within the shaft bore 70 with the rod attachment 94 extending outward from the shaft bore 70 of the shaft 40 for attaching the handle 50 to the rod 90.

In this example, the handle 50 is removably affixed to the rod attachment 94. The handle 50 includes a threaded bore 55 for threadably receiving a threaded insert 56. The threaded insert 56 includes external threads 57 and internal threads 58. The external threads 57 threadably engage with the threaded bore 55 of the handle 50. Preferably, the threaded insert 56 is secured within the threaded bore 55 of the handle 50 to prevent rotation of the threaded insert 56. The internal threads 58 of the threaded insert 56 threadably receive the rod attachment 94 for enabling the handle 50 to be threadably engaged with and disengaged from the rod 90.

The retainer orifice 114 of the retainer 110 and the rod slider 100 are keyed for preventing rotation between the rod slider 100 and the shaft 40. The key of the retainer orifice 114 and the key of the rod slider 100 enable the handle 50 to be threadably disengaged and engaged with the rod slider 100. The handle 50 is threadably disengaged from the rod slider 100 to remove a depleted roll 12 of sheet material from the shaft 40 as shown in FIG. 8. The handle 50 is threadably engaged with the rod slider 100 to insert a new roll 12 of sheet material onto the shaft 40 as shown in FIGS. 1–5.

Figure 1:
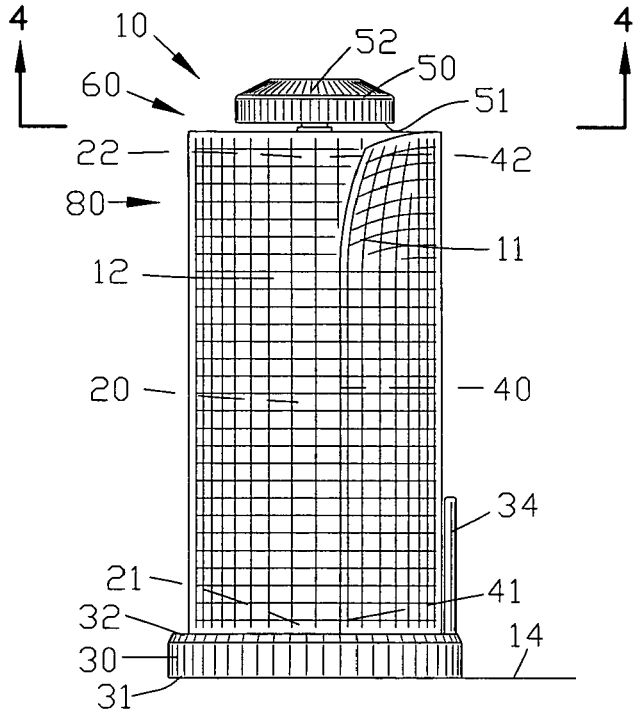
FIG. 1 is a side view of a first embodiment of an apparatus for dispensing sheet material from a roll incorporating of the present invention.
Figure 3:
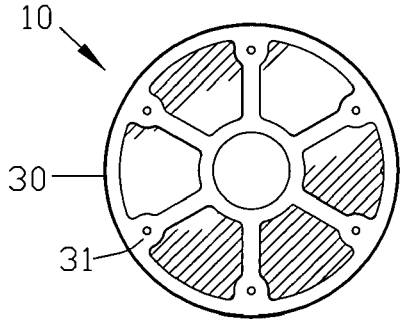
FIG. 3 is a bottom view of FIG. 1.
Figure 4:
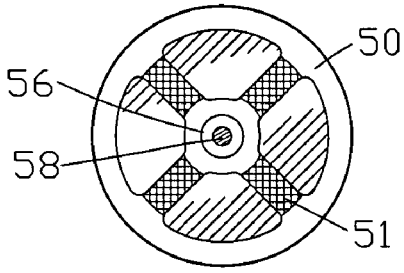
FIG. 4 is a sectional view along line 4—4 in FIG. 1.
Figure 10:
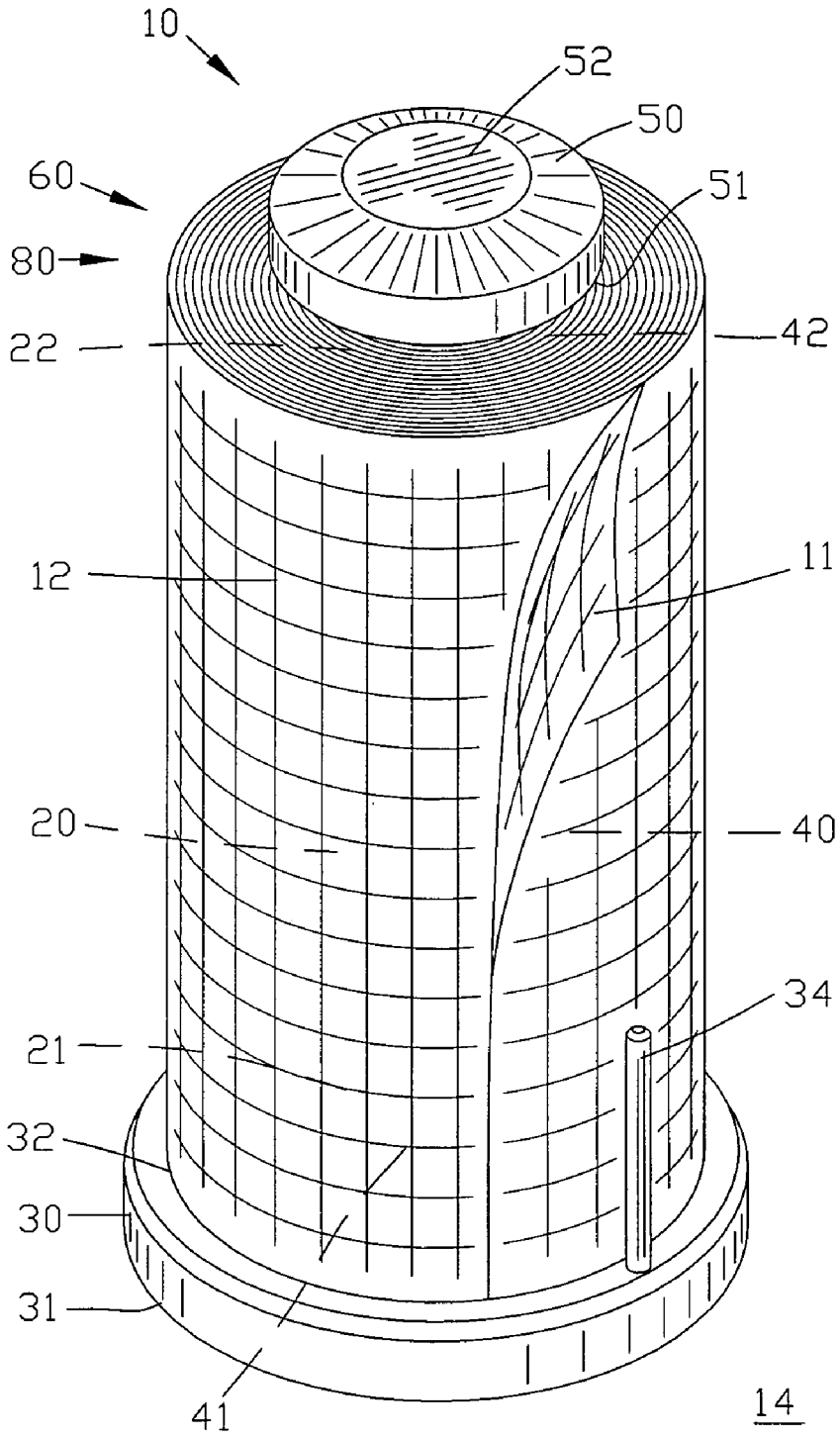
FIG. 10 is an isometric view of the apparatus of FIG. 1 with the roll of sheet material being dispensed from the apparatus.

FIG. 10 is an isometric view of the apparatus 10 of FIG. 1 with the roll 12 of sheet material 11 being dispensed from the apparatus 10. The magnetic force 60 produced by the repulsive force of magnets 61 and 62 for spacing the stop surface 51 of the handle 50 from the roll 12 of the sheet material 11 as shown in FIG. 6. The spacing of the stop surface 51 of the handle 50 from the roll 12 of the sheet material 11 enabling the roll 12 of the sheet material 11 to rotated about the shaft 40 to dispense sheet material 11 from the roll 12.

Figure 11:
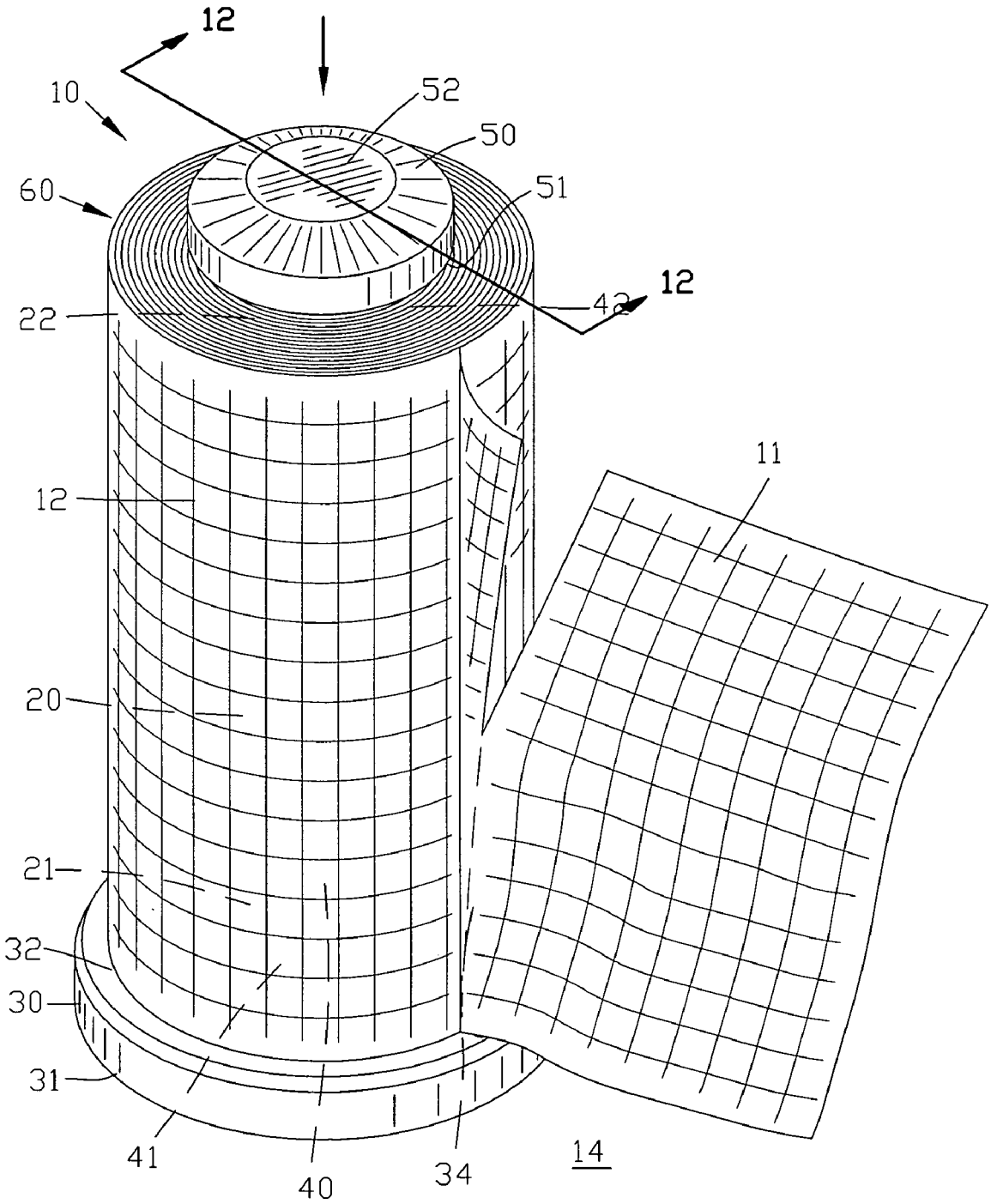
FIG. 11 is an isometric view similar to FIG. 10 illustrating a stop surface of a handle engaging the roll of sheet material to enable a sheet of material to be removed from the roll.

FIG. 11 is an isometric view similar to FIG. 10 illustrating the stop surface 51 of a handle 50 engaging the roll 12 of sheet material 11. The stop surface 51 engaging the roll 12 of sheet material 11 enables an operator to tear the dispensed sheet material 11 from the roll 12.

Figure 12:
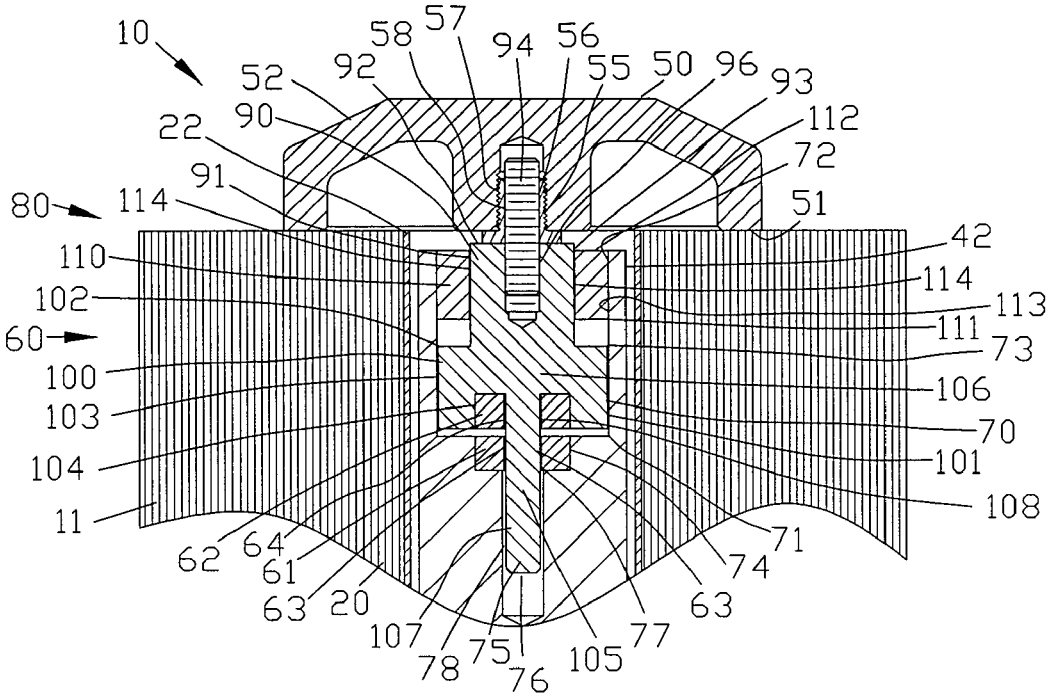
FIG. 12 is a magnified view similar to FIG. 6 illustrating the stop surface of the handle engaging the roll of sheet material as shown in FIG. 11.

FIG. 12 is a magnified view similar to FIG. 6 illustrating the stop surface 51 of the handle 50 engaging the roll 12 of sheet material 11 as shown in FIG. 11. The handle 50 enables an operator (not shown) to slide the stop engaging surface 51 against the repulsive magnetic force 60 produced by the magnets 61 and 62. The stop surface 51 engaging against the roll 12 of the sheet material 11 inhibits rotation of the roll 12 of the sheet material 11 about said shaft 40. The inhibiting of the rotation of the roll 12 of the sheet material 11 about said shaft 40 enables the operator to tear the dispensed sheet material 11 from the roll 12.

Upon release of the handle 50 by the operator (not shown), the magnetic repulsive force 60 produced by the magnets 61 and 62 spaces the stop surface 51 of the handle 50 from the roll 12 of the sheet material 11 as shown in FIG. 6. The spacing of the stop surface 51 from the roll 12 of the sheet material 11 enabling the roll 12 to rotated about the shaft 40 to dispense sheet material 11 from the roll 12.

Figure 13:
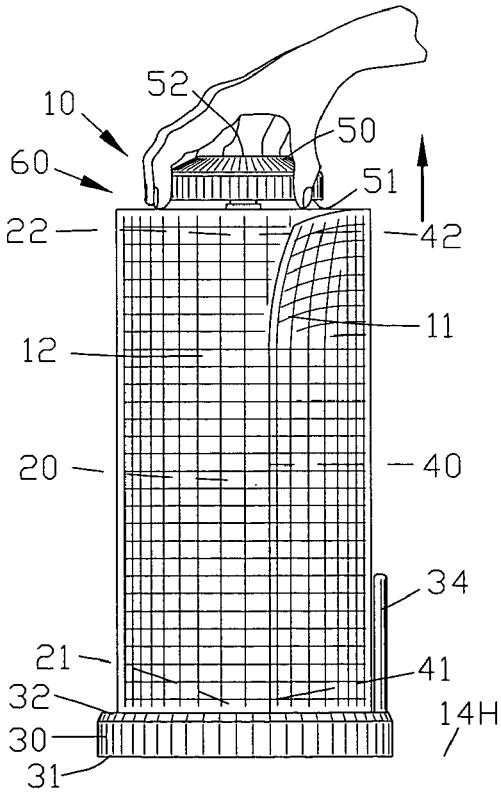
FIG. 13 illustrates the apparatus of the present invention being transported by the handle.

FIG. 13 illustrates the apparatus 10 of the present invention being transported by the handle 50. The retainer 110 is secured to the shaft 40 with the retainer orifice 114 slidably receiving the rod 90. The rod slider 100 slidably engages with the shaft bore 70 and with the rod attachment 94 extending outward from the shaft bore 70 for attaching the handle 50 to the rod 90. The rod slider 100 is enlarged relative to the retainer orifice 114 for inhibiting removal of the rod 90 from the shaft 40. The rod slider 100 in combination with the retainer orifice 114 enables the apparatus 10 to be lifted by the handle 50 as shown in FIG. 13.

Figure 14:
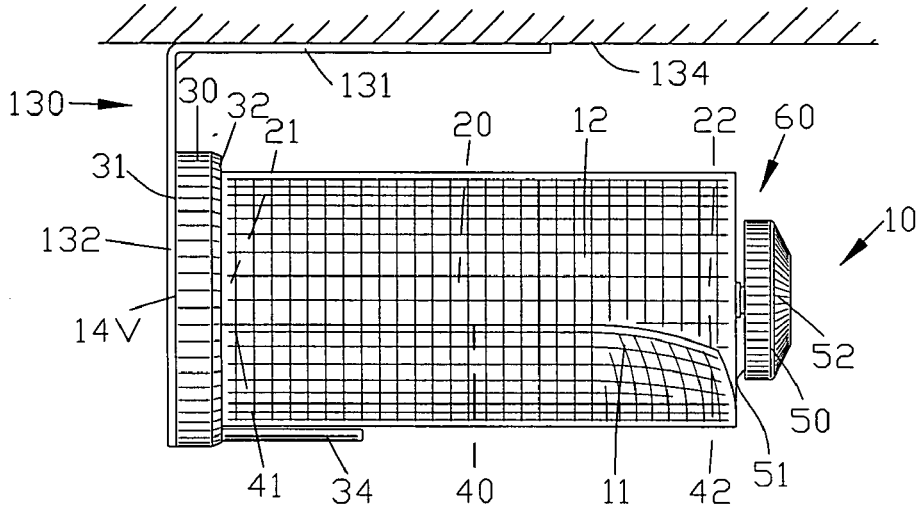
FIG. 14 illustrates an alternative method for mounting the apparatus of the present invention.

FIG. 14 illustrates an alternative method for mounting the apparatus 10 of the present invention. The base support surface 31 of the base 30 is permanently mounted to a vertical ambient surface 14V. In this example, an L-shaped bracket 130 has a horizontal component 131 and a vertical component 132. The horizontal component 131 is secured to a horizontal surface 134 such as an underside of a cabinet or the like. The vertical component 132 of the L-shaped bracket 130 defines the vertical ambient surface 14V. The base support surface 31 of the base 30 may be permanently mounted to the ambient vertical surface 14V by a suitable mechanical fastener or an adhesive fastener. The retainer 110 inhibits removal of the rod 90 from the shaft 40 to retain the roll 12 of sheet material 11 on the shaft 40 of the apparatus 10.

Figure 15:
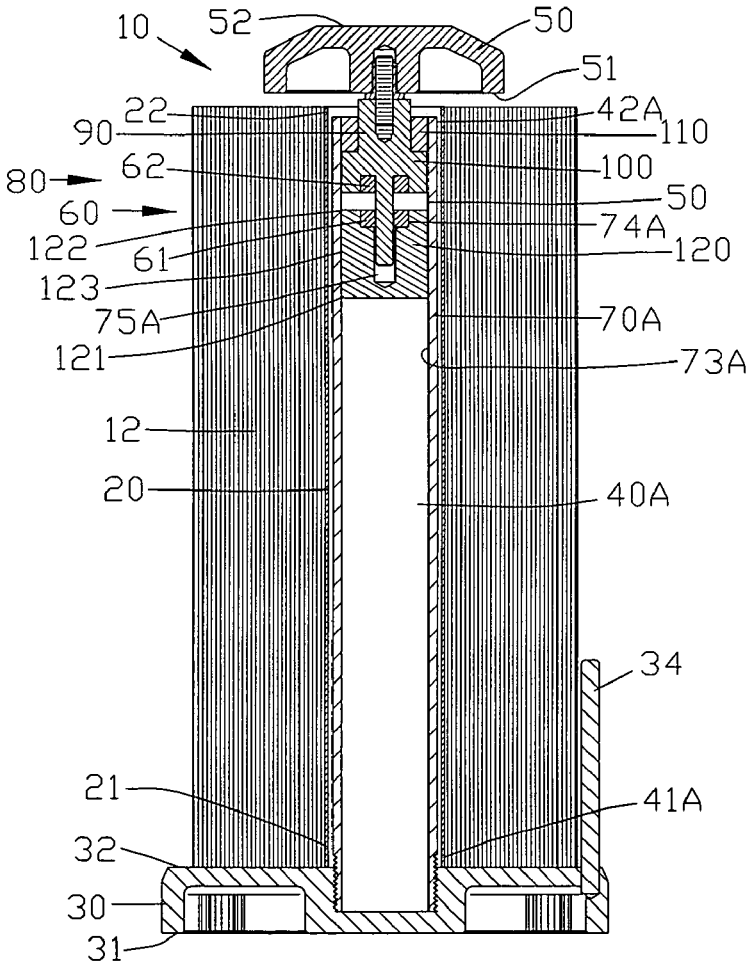
FIG. 15 is a sectional view similar to FIG. 5 illustrating an alternative construction of the apparatus.

FIG. 15 is a sectional view similar to FIG. 5 illustrating an alternative construction of the apparatus 10. In this example, the shaft 40A is shown as a hollow shaft 40A having the shaft bore 70A defined within the shaft 40A. The shaft bore 70A extends entirely through the shaft 40A between the first and second ends 41A and 42A of the shaft 40A.

A plug 120 extends between a first and a second end 121 and 122 and defines a generally cylindrical sidewall 123. The sidewall 123 of the plug 120 is adapted to be received by the internal sidewall 73A of the shaft bore 70A. The plug 120 is affixed within the shaft bore 70A to define a termination of the shaft bore 70A at the first end 71. In this alternative, the shaft recess 74A and the counterbore 75A are defined within the plug 120. In another alternative, the plug 120 may be integrally molded with the shaft 40A.

FIGS. 16–20 are various views of a second embodiment of the apparatus 10 for dispensing sheet material 11 from a roll 12 wrapped about a core 20 incorporating the present invention. In this example of the invention, the base support surface 31 of the base 30 includes a plurality of legs 140. The legs 140 may be secured to the base support surface 31 of the base 30 by an adhesive or any other suitable means. The legs 140 may also be secured to the base support surface 31 of the base 30 by inserting the legs 140 into a plurality of base apertures 142. The legs 140 may be constructed of rubber or other similar material. The legs 140 assist in preventing the base support surface 31 of the base 30 from sliding along the ambient surface 14.

The sheet keeper 34 shown in the first embodiment which extends from the base 30 for preventing the unrolling of the sheet material 11 from the roll 12 wrapped about the core 20 has been removed in the second embodiment as shown in FIGS. 16, 20 and 22–24.

Figure 16:
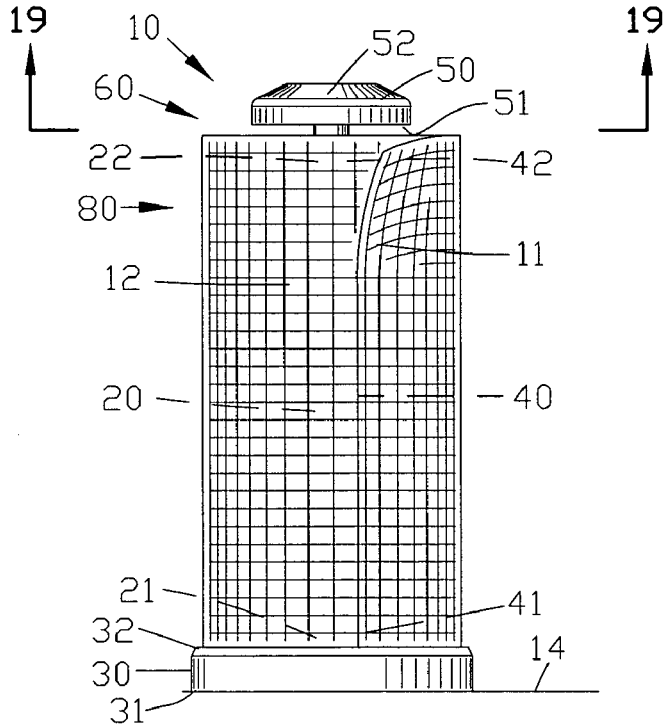
FIG. 16 is a side view of a second embodiment of an apparatus for dispensing sheet material from a roll incorporating of the present invention.
Figure 18:
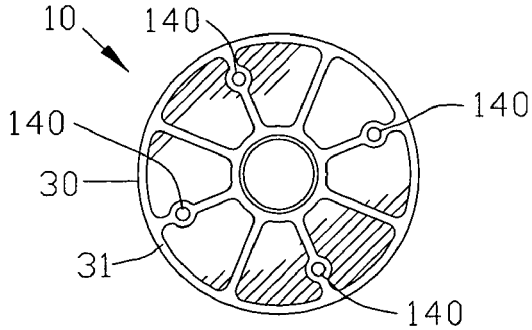
FIG. 18 is a bottom view of FIG. 16.
Figure 19:
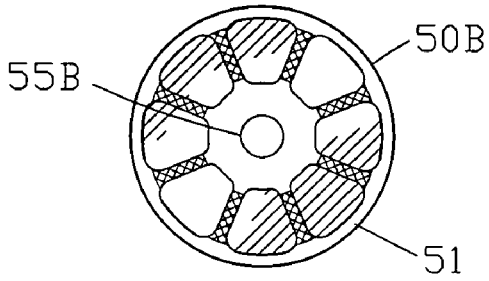
FIG. 19 is a sectional view along line 19—19 in FIG. 16.

FIG. 19 is a sectional view along line 19—19 in FIG. 16 illustrating the construction of a handle 50B. In the second embodiment, the handle 50B includes a threaded bore 55B with the treaded insert 56 as shown in the first embodiment omitted.

Figure 17:
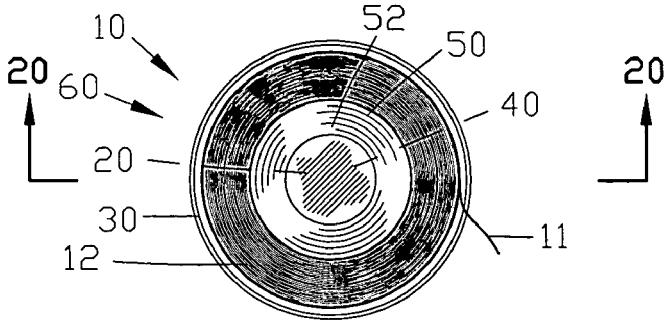
FIG. 17 is a top view of FIG. 16.
Figure 20:
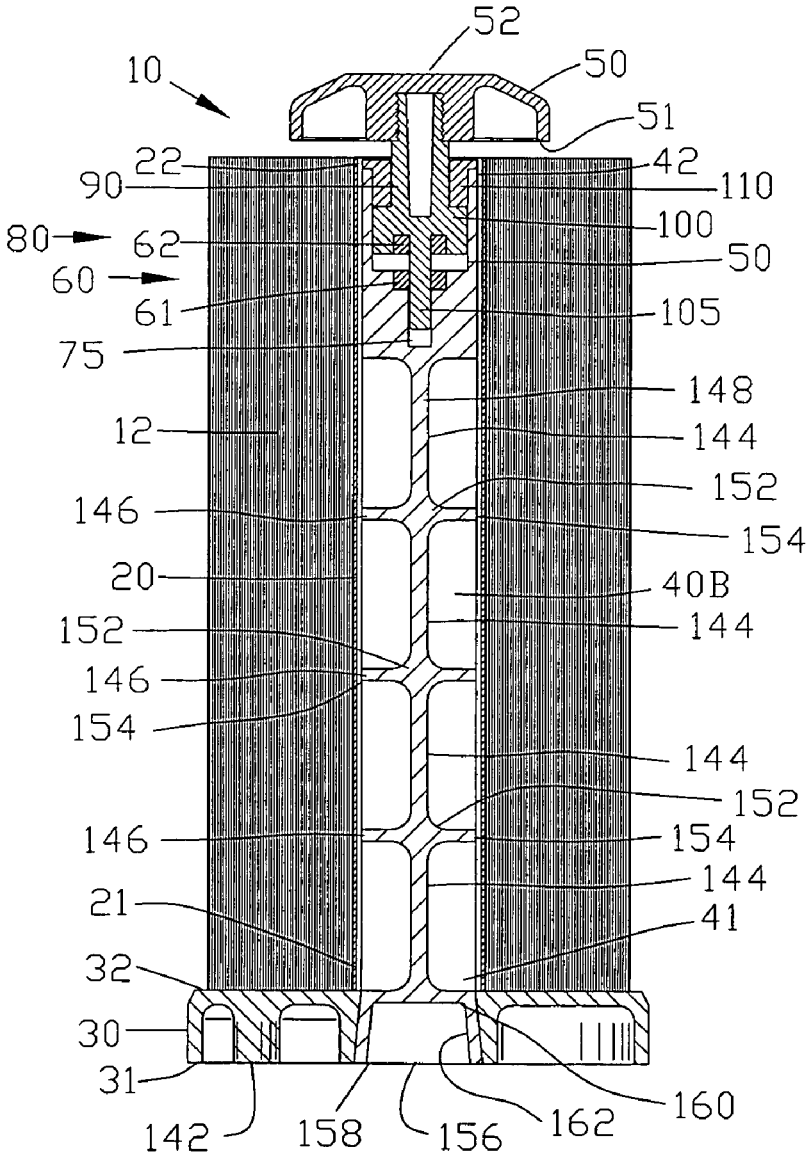
FIG. 20 is a sectional view along line 20—20 in FIG. 17.

FIG. 20 is a sectional view along line 20—20 in FIG. 17 illustrating the construction of a shaft 40B. In the second embodiment, the shaft 40B is shown as having a ribbed shaft portion 41B. The ribbed shaft portion 41B has a plurality of vertical ribs 144 and a plurality of horizontal ribs 146 defined within the shaft 40B. The plurality of vertical ribs 144 extend from an interior end 148 to an exterior end 150. The plurality of horizontal ribs 146 extend from an interior end 152 to an exterior end 154. The exterior end 150 of the plurality of vertical ribs 144 and the exterior end 154 of the plurality of horizontal ribs 146 intersect to form a generally cylindrical cross-section 155. The dimensions of the generally cylindrical cross-section 155 is commensurate to the cross-section dimensions of the second end 42 of the shaft 40B for enabling the roll 12 of the sheet material 11 to rotate about the shaft 40B to dispense sheet material 11 from the roll 12. The shaft 40B may also include a bore 156 defined within the shaft 40B. The bore 156 extends from a first end 158 to a second end 160 and defines an internal sidewall 162.

Figure 21:
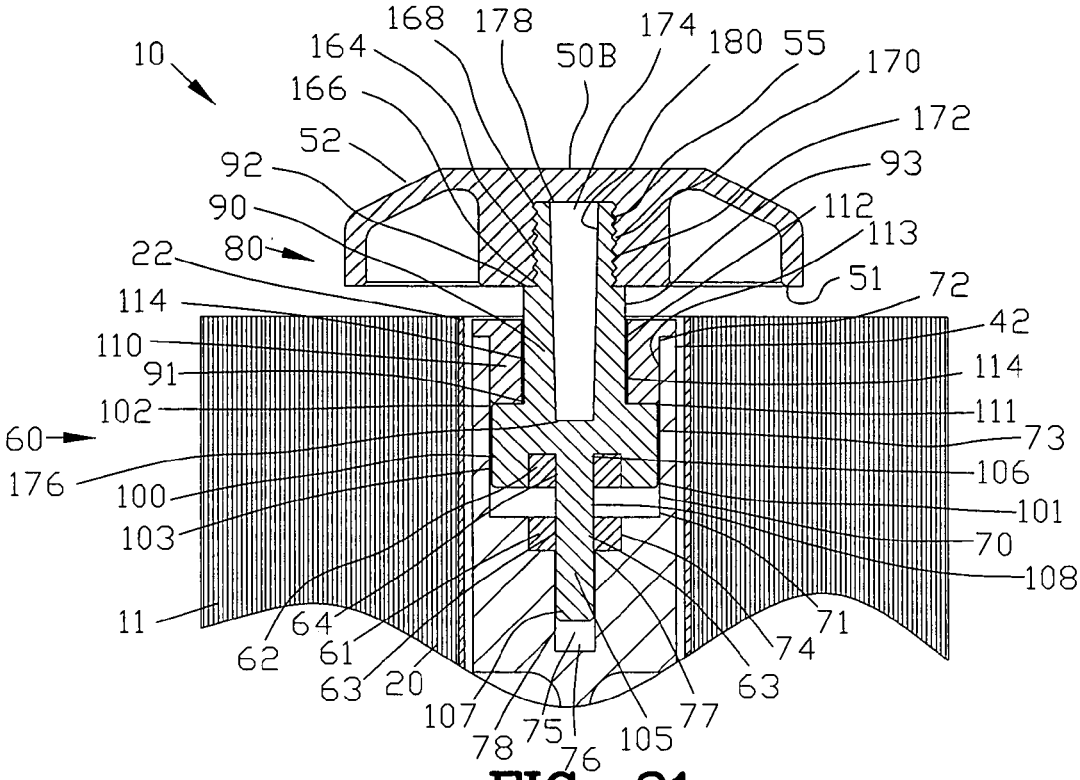
FIG. 21 is a magnified view of an upper portion of FIG. 20.
Figure 22:
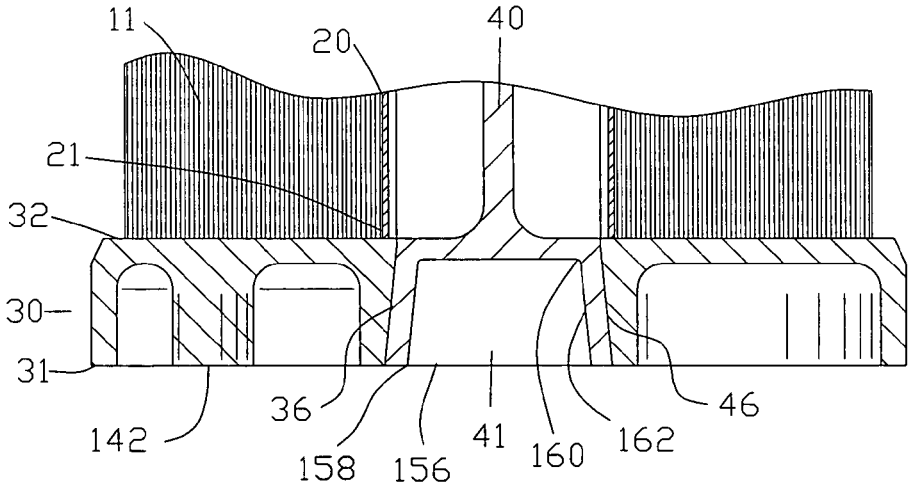
FIG. 22 is a magnified view of a lower portion of FIG. 20.

FIGS. 21 and 22 are enlarged views of portions of FIG. 20. In the second embodiment of the apparatus 10, a rod extender 164 is secured to the second end 92 of the rod 90 for removably attaching the handle 50B to the rod 90. The rod extender 164 extends between a first and a second end 166 and 168. The rod extender 164 defines a sidewall 170 having a generally circular cross-section. The sidewall 170 of the rod extender 164 has an exterior threading 172. Preferably, the rod 90 and the rod extender 164 are formed as a unitary one pieced unit.

Also in the second embodiment, a bore 174 may be defined within both the rod extender 164 and the rod 90. The bore 174 extends from a first end 176 to a second end 178 and defines an internal sidewall 180.

The rod slider 100 is slidably retained within the shaft bore 70 with the rod extender 164 extending outward from the shaft bore 70 of the shaft 40B for attaching the handle 50B to the rod 90. In this example, the handle 50B is removably affixed to the rod extender 164. The threaded bore 55B of the handle 50B threadably receives the exterior threading 172 of the rod extender 164 for enabling the handle 50B to be threadably engaged with and disengaged from the rod 90.

Figure 23:
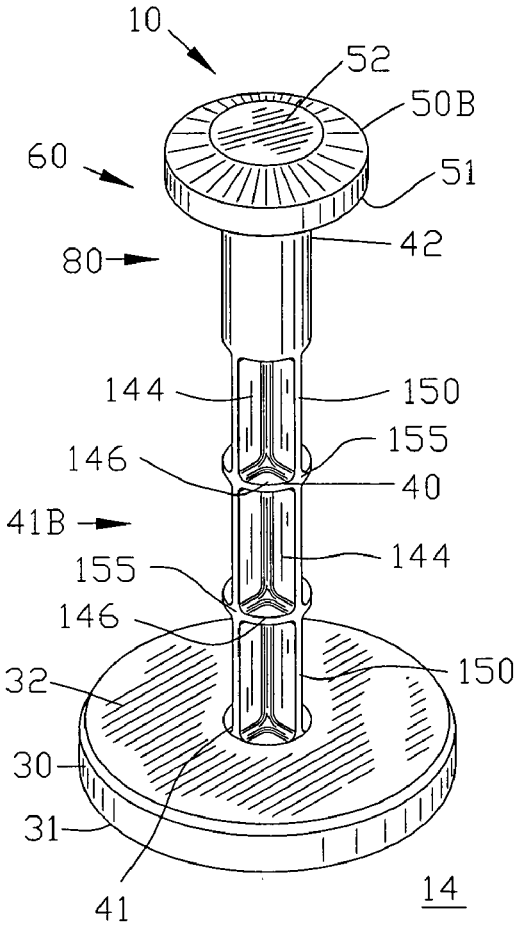
FIG. 23 is an isometric view of the apparatus of FIGS. 16–22 without the roll of sheet material.
Figure 24:
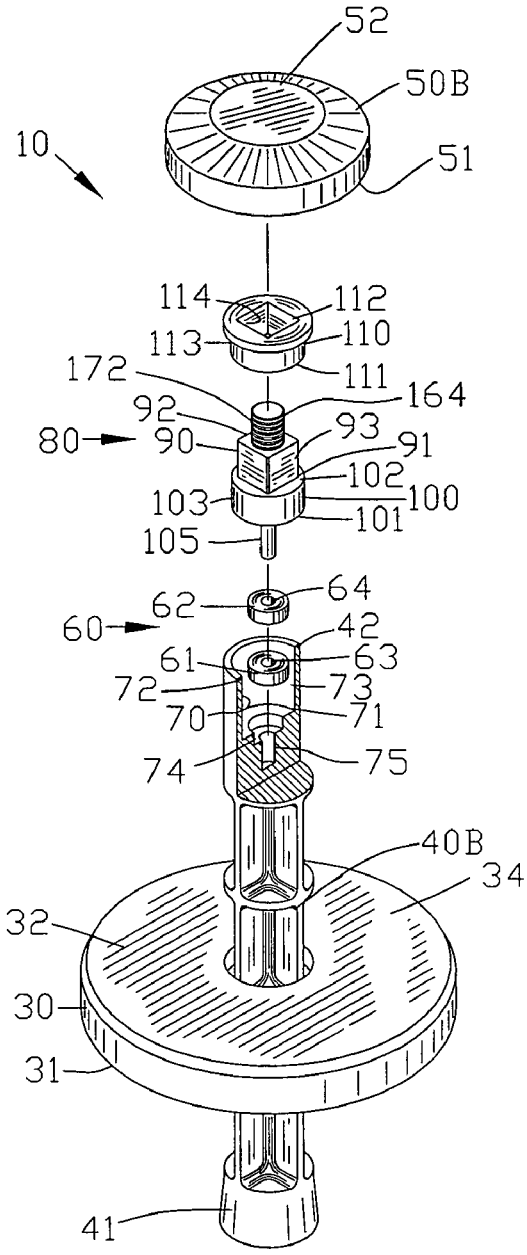
FIG. 24 is an exploded view of FIG. 23.

FIGS. 23 and 24 are isometric assembled and exploded views the second embodiment of the apparatus 10 of FIGS. 16–22 without the roll 12 of sheet material 11 thereon.

The present invention provides an apparatus 10 for dispensing a sheet material 11 from a roll 12 that overcomes many of the problems of the prior art. The apparatus 10 incorporates a magnetic force 60 in association with a stop surface 51 for inhibiting rotation of a roll 12 of sheet material 12 on the shaft 40. The apparatus provides a simple and inexpensive solution for the art of dispensing a sheet material 11 from a roll 12. The apparatus 10 may be shipped in an unassembled form and be readily assembled by an operator.

The present disclosure includes that contained in the appended claims as well as that of the foregoing description. Although this invention has been described in its preferred form with a certain degree of particularity, it is understood that the present disclosure of the preferred form has been made only by way of example and that numerous changes in the details of construction and the combination and arrangement of parts may be resorted to without departing from the spirit and scope of the invention.

What is claimed is:

1. An apparatus for dispensing sheet material from a roll located on a core, comprising:

a base having a base support surface and a base engaging surface;

a shaft secured to said base for extending through the core of the roll of the sheet material;

said shaft comprises a shaft bore defined in said shaft for slidably receiving said slider;

a handle having a stop engaging surface;

a slider for slidably mounting said handle to said shaft;

said slider comprising a rod extending between a first and a second end;

said first end of said rod having a rod slider and with said second end of said rod having a rod attachment;

a retainer secured to said shaft having a retainer orifice for slidably receiving said rod with said rod slider slidably engaging said shaft bore and with said rod attachment extending outward from said shaft bore for attaching handle said handle to said rod;

said retainer orifice and said rod slider being keyed for preventing rotation between said rod slider and said shaft;

said rod slider being enlarged relative to said retainer orifice for inhibiting removal of said slider rod from said shaft;

a first and a second magnet secured respectively to said shaft and said handle for providing a repelling magnetic force therebetween;

said repelling magnetic force spacing said stop surface of said handle from the roll of the sheet material for enabling the roll of the sheet material to rotated about said shaft to dispense sheet material from the roll;

said handle enabling an operator to slide said stop engaging surface against the roll of the sheet material for inhibiting rotation of the sheet material about said shaft to tear the dispensed sheet material from the roll.

2. An apparatus for dispensing sheet material from a roll located on a core, comprising:

a base having a base support surface and a base engaging surface;

a shaft secured to said base for extending through the core of the roll of the sheet material;

said shaft comprises a shaft bore defined in said shaft for slidably receiving said slider;

a handle having a stop engaging surface;

a slider for slidably mounting said handle to said shaft;

said slider comprising rod extending between a first and a second end;

said first end of said rod having a rod slider and with said second end of said rod having a rod attachment;

said rod attachment comprising a threaded shaft for threadably engaging with a threaded opening in said handle for securing said handle to said rod slider;

a retainer secured to said shaft having a retainer orifice for slidably receiving said rod with said rod slider slidably engaging said shaft bore and with said rod attachment extending outward from said shaft bore for attaching handle said handle to said rod;

said retainer orifice and said rod slider being keyed for preventing rotation between said rod slider and said shaft for enabling said handle to be threadably disengaged from said rod slider;

said rod slider being enlarged relative to said retainer orifice for inhibiting removal of said slider rod from said shaft for enabling the apparatus to be lifted by said handle;

a first and a second magnet secured respectively to said shaft and said handle for providing a repelling magnetic force therebetween;

said repelling magnetic force spacing said stop surface of said handle from the roll of the sheet material for enabling the roll of the sheet material to rotated about said shaft to dispense sheet material from the roll; and said handle enabling an operator to slide said stop engaging surface against the roll of the sheet material for inhibiting rotation of the sheet material about said shaft to tear the dispensed sheet material from the roll.

3. An apparatus for dispensing sheet material from a roll located on a core, comprising:

a base having a base support surface and a base engaging surface;

a shaft secured to said base for extending through the core of the roll of the sheet material with said shaft having a shaft bore defined in said shaft;

a handle having a stop engaging surface;

a slider comprising rod extending between a first and a second end with said first end of said rod having a rod slider and with said second end of said rod having a threaded rod attachment;

a retainer secured to said shaft having a retainer orifice for slidably receiving said rod with said rod slider slidably engaging said shaft bore and with said rod attachment extending outward from said shaft bore for threadably attaching said handle to said rod;

a first and a second magnet secured respectively secured to said shaft and said rod slider for providing a repelling magnetic force therebetween;

said repelling magnetic force spacing said stop surface of said handle from the roll of the sheet material for enabling the roll of the sheet material to rotated about said shaft to dispense sheet material from the roll;

said handle enabling an operator to slide said stop engaging surface against the roll of the sheet material for inhibiting rotation of the sheet material about said shaft to tear the dispensed sheet material from the roll;

said retainer orifice and said rod slider being keyed for preventing rotation between said rod slider and said shaft for enabling said handle to be threadably disengaged from said rod slider; and said rod slider being enlarged relative to said retainer orifice for inhibiting removal of said slider rod from said shaft for enabling the apparatus to be lifted by said handle.

4. An apparatus for dispensing sheet material from a roll located on a core, comprising:

a base having a base support surface and a base engaging surface;

a shaft secured to said base for extending through the core of the roll of the sheet material;

a handle having a stop engaging surface;

a slider for slidably mounting said handle to said shaft;

a first and a second magnet secured respectively to said shaft and said handle for providing a repelling magnetic force therebetween;

said repelling magnetic force spacing said stop surface of said handle from the roll of the sheet material for enabling the roll of the sheet material to rotated about said shaft to dispense sheet material from the roll;

said handle enabling an operator to slide said stop engaging surface against the roll of the sheet material for inhibiting rotation of the sheet material about said shaft to tear the dispensed sheet material from the roll;

said shaft comprises a shaft bore defined in said shaft for slidably receiving said slider;

said slider comprising a rod extending between a first and a second end;

said first end of said rod having a rod slider for sliding engagement with said shaft bore;

said second end of said rod having a rod extender for removably attaching said handle to said rod;

a retainer secured to said shaft having a retainer orifice for slidably receiving said rod with said rod slider slidably engaging said shaft bore and with said rod extender extending outward from said shaft bore for attaching said handle to said rod; and said retainer orifice and said rod slider being keyed for preventing rotation between said rod slider and said shaft.

5. An apparatus for dispensing sheet material from a roll as set forth in claim 4, including said rod slider being enlarged relative to said retainer orifice for inhibiting removal of said slider rod from said shaft.

6. An apparatus for dispensing sheet material from a roll as set forth in claim 4, wherein said rod extender comprising a exterior threading for threadably engaging with a threaded bore in said handle for securing said handle to said rod slider.

7. An apparatus for dispensing sheet material from a roll located on a core, comprising:

a base having a base support surface and a base engaging surface;

a shaft secured to said base for extending through the core of the roll of the sheet material with said shaft having a shaft bore defined in said shaft;

a handle having a stop engaging surface;

a slider comprising rod extending between a first and a second end with said first end of said rod having a rod slider and with said second end of said rod having a rod extender;

a retainer secured to said shaft having a retainer orifice for slidably receiving said rod with said rod slider slidably engaging said shaft bore and with said rod extender extending outward from said shaft bore for threadably attaching said handle to said rod;

a first and a second magnet secured respectively secured to said shaft and said rod slider for providing a repelling magnetic force therebetween;

said repelling magnetic force spacing said stop surface of said handle from the roll of the sheet material for enabling the roll of the sheet material to rotated about said shaft to dispense sheet material from the roll;

said handle enabling an operator to slide said stop engaging surface against the roll of the sheet material for inhibiting rotation of the sheet material about said shaft to tear the dispensed sheet material from the roll;

said retainer orifice and said rod slider being keyed for preventing rotation between said rod slider and said shaft for enabling said handle to be threadably disengaged from said rod slider; and said rod slider being enlarged relative to said retainer orifice for inhibiting removal of said slider rod from said shaft for enabling the apparatus to be lifted by said handle.

* * * * *